United States Patent [19]

Trumbauer et al.

[11] Patent Number: 4,691,754

[45] Date of Patent: Sep. 8, 1987

[54] METHOD FOR FORMING CASTINGS HAVING INSERTS

[75] Inventors: David V. Trumbauer, Denver, Iowa; Larry L. Fosbinder, Moline, Ill.; Terry L. Erion, Janesville, Iowa

[73] Assignee: Deere & Company, Moline, Ill.

[21] Appl. No.: 814,970

[22] Filed: Dec. 31, 1985

[51] Int. Cl.[4] ..... B22C 7/02; B22C 9/10; B22D 19/00

[52] U.S. Cl. ..... 164/9; 164/32; 164/34; 164/112; 164/246; 164/332; 164/369

[58] Field of Search ..... 164/11, 9, 10, 34, 98, 164/30, 31, 32, 112, 246, 332, 333, 334, 369, 370

[56] References Cited

U.S. PATENT DOCUMENTS

| | | | |
|---|---|---|---|
| Re 31,488 | 1/1984 | Trumbauer | 164/34 X |
| 4,243,093 | 1/1981 | Nieman | 164/9 X |
| 4,285,385 | 8/1981 | Hayashi et al. | 164/9 |

*Primary Examiner*—J. Reed Batten, Jr.

[57] ABSTRACT

A core assembly is formed by molding a destructible plastic form around at least one insert and optionally around a non-destructible core. The core assembly can be used, for example, for casting engine cylinder heads having valve seat inserts integral therewith. The plastic form retains and supports the inserts until the precise time the plastic is replaced by the molten metal.

18 Claims, 2 Drawing Figures

Fig. 1
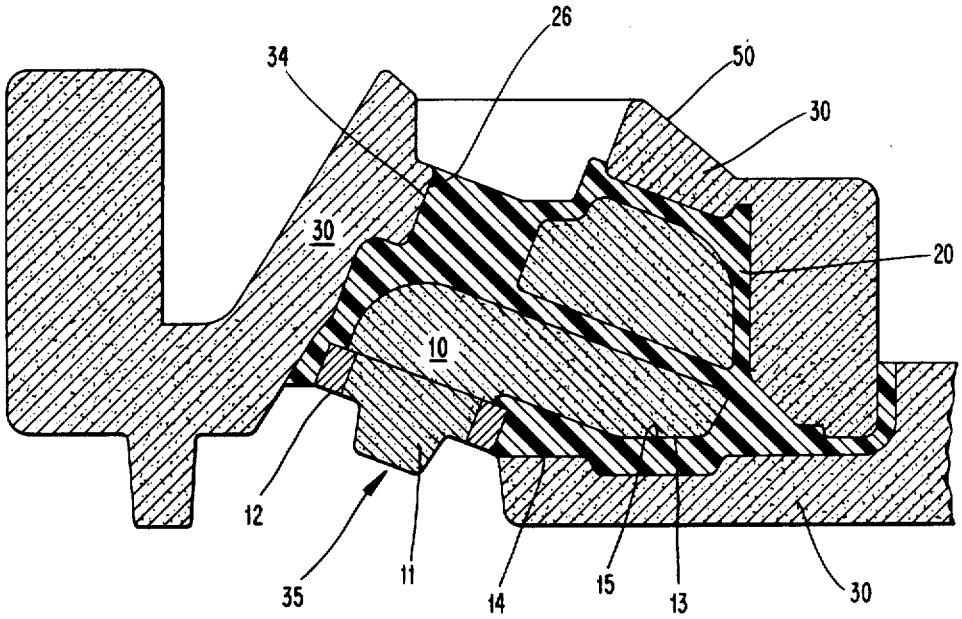
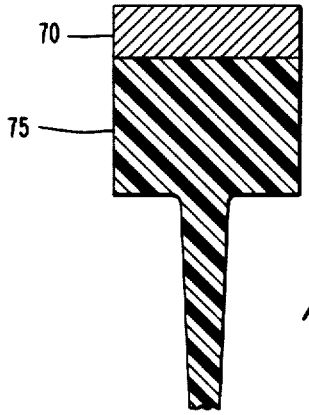
Fig. 2

METHOD FOR FORMING CASTINGS HAVING INSERTS

BACKGROUND AND OBJECTS OF THE INVENTION

The present invention relates to foundry tooling processes and methods and more particularly to a core assembly for use in casting operations.

Certain composite articles or castings have an insert or inlay integral with the casting. Examples of such inserts include valve seats for cylinder heads and steel or ceramic inserts for certain gray iron castings. The inserts may be snap fit or force fit into place to form the composite article. However, the present invention provides a method for forming such composite castings by using cast-in-place inserts. The composite castings thus formed not only provide a precisely positioned insert in the composite casting, but such inserts may be held in place by a metallurgical bonding of the insert to the cast metal.

To provide castings having inserts by the method of the present invention, it is important that the insert be precisely positioned in the casting, such as for the valve seat inserts mentioned above. When such precision is required, it is therefore critical that the insert be properly positioned when the casting is made. For such cast-in-place inserts, it is equally important that the location or positioning of the insert be maintained during the casting or molding process. Therefore, if the positioning of the insert is incorrect or if the location of the positioned insert changes during the casting or molding, casting defects and dimensional problems are likely to occur.

The present invention relates generally to a process in which a destructible plastic form is molded in the configuration of the article to be cast around a core. The composite plastic form and core is then placed in a mold cavity. Metal is cast into the mold cavity to vaporize the plastic form. The metal thus replaces the plastic form to form a shaped casting about the core which is thereafter removed.

It is known to use various methods of positioning articles in casting molds. For example, the "lost wax" process of casting, such as disclosed in U.S. Pat. Nos. 4,154,282 and 4,392,289, is used to cast a gem for the manufacture of jewelry. In the lost wax process, a gem is positioned in a mold and wax is cast therein to form a wax model; the model is subsequently covered with a non-destructible hardenable material, the wax is melted out, metal is cast into the void created by the wax and the hardenable material is removed. However, the lost wax process is different from the process employed in the present invention and presents different problems. The lost wax process involves introducing molten metal into voids created by the wax as opposed to the present process wherein the molten metal simultaneously vaporizes the plastic form and fills the space occupied by the plastic form. A problem associated with the lost wax process is that the article is supported by the hardenable material within the mold (i.e., the void space previously occupied by the wax), and it is therefore impossible to have an article supported within a void such that metal can be cast totally around the article because the lost wax process requires that the article be supported by the non-destructible hardenable material.

Another method for positioning an insert is by means of posts extending from the core box into the insert, as disclosed in U.S. Pat. No. 4,008,747. A disadvantage with this method is that the shape, orientation and location of the insert must be such that it can be supported by posts.

U.S. Pat. No. 4,243,093 discloses composite cast articles having insulating portions intermediate of the cast portions and which are contiguous with the outer configuration of the casting. This patent discloses forming destructible plastic portions which are assembled, such as with an adhesive, to be used in lost foam casting. There are many problems associated with the method of this patent. For example, the use of glue to join destructible portions means that the cores thus formed are subject to breakage due to handling. Excess glue may act as a core thereby creating a void in the casting. Similarly, to position the insulating article between the destructible portions, the entire assembly must be assembled step by step: forming the inner portions and gluing them together, positioning the insulating layer around the inner portions and forming the outer portions and gluing them together around the insulating layer. The present invention overcomes this burdensome task by forming a destructible pattern having an insert without the need to assemble the destructible portions about the insert.

It is, therefore, an object of the present invention to provide metal castings having inserts located therein. It is also an object of the present invention to provide a method for manufacturing such castings.

It is another object of the present invention to provide composite cores for the manufacture of metal castings having inserts therein and a method for manufacturing such composite cores.

It is a further object of the present invention to provide a method of manufacturing metal castings having inserts located precisely therein. It is also an object of the present invention to provide a method for the precise positioning of inserts in composite cores for the manufacture of such metal castings.

SUMMARY OF THE INVENTION

The present invention provides a method of casting metal castings including an insert comprising the steps of: forming a composite core assembly by: positioning in a mold cavity at least one insert; molding in said mold cavity a destructible form of plastic material at least partially about said at least one insert to form a composite core wherein said at least one insert is supported by said plastic material; inserting said composite core into a mold cavity; and introducing molten metal into said mold cavity to destroy said plastic form and produce a casting having said at least one insert integral therewith.

In general, one or more inserts is positioned in a mold cavity which is in the configuration of the article to be cast. For descriptive purposes, the insert will hereinafter be referred in the singular form although it should be understood that multiple inserts may be used in specific applications of the present process. A destructible plastic material is introduced into the mold cavity and molded so as to produce a destructible plastic form in the shape of the article to be cast and having positioned therein the insert, thereby forming a composite core. The insert is located in the plastic form in the precise location it will be relative to the metal casting. This composite core assembly comprising the plastic form and insert is placed in a mold for casting metal, such as a foundry mold where sand is packed around the composite assembly. When the molten metal is cast into the mold, it vaporizes the plastic form and replaces it. During the casting operation, the insert is held in place until the exact time the plastic is replaced with the metal. The finished casting is thus formed having the insert integral therewith and precisely located therein. The composite core assembly may also include a preformed core (e.g., sand core).

BRIEF DESCRIPTION OF THE DRAWINGS

In describing the invention, reference will be made to preferred embodiments shown in the appended drawings in which:

FIG. 1 is a cross-sectional view depicting a composite core assembly according to the present invention for use in forming a cylinder head; and FIG. 2 is a cross-sectional view depicting a composite core assembly according to the present invention for use in forming a piston.

DETAILED DESCRIPTION OF THE INVENTION

FIG. 1 illustrates a core arrangement employed in the foundry process for casting a cylinder head. The core assembly 50 comprises a first, or inner, core 10. Fabrication of the inner core is carried out in any suitable manner. For instance, the inner core can be molded of silica sand and binder such as phenolic base and/or modified phenolic base resin, or by other conventional techniques.

To aid in positioning the cores and to avoid gluing cores together, it has been found advantageous to form a layer 20 of destructible plastic material around a portion of the inner core 10, as disclosed in U.S. Pat. No. Re. 31,488, which is assigned to the assignee of the present invention, the disclosure of which is herein incorporated by reference. The destructible layer 20 can be molded in place around the first core 10 by placing the first core 10 into a molding machine and subsequently forming the layer 20 around the core 10.

It has now been found that a casting having at least one insert precisely located therein can be formed by producing a core surrounded by a destructible layer of plastic material wherein the layer also supports an insert. Hence, the first core 10 is placed into a molding machine and at least one insert, such as valve seat 12, is positioned therein. Subsequently, a layer of destructible plastic material is molded around the first core 10 and the insert 12 to form a destructible layer whose inner surface 13 intimately contacts and forms to the configuration of the outer surface 15 of the first core and which retains and supports the insert. The outer surface 14 of the molded destructible layer is configured in accordance with the desired shape of the cylinder head. The plastic layer encompasses the first core and insert such that neither can be removed in any direction. The plastic material "supports" the insert not only by physically retaining the insert, but also by maintaining the three-dimensional, spatial location of the insert with respect to the configuration of the plastic material and the first core. Thus, the insert also will remain in its precise spatial location during casting to provide the desired final product.

The term "insert" as used herein connotes a material which is non-destructible at the temperature of the molten metal to be cast. By "non-destructible" it is meant that the material will not melt, vaporize or start to deform at such temperatures. The materials which may be used for inserts include metals and alloys other than the metal or alloy to be cast as well as known ceramics and inorganics which have high melting points, such as various metal oxides, borides, nitrides, carbides, silicates and other high melting point metal compounds, as well as mixtures thereof. The insert material is also chosen to be non-removeable after casting (as distinct from a core material, discussed in more detail below) as the insert is intended to be a permanent part of the cast article.

The material of which the insert is comprised is distinguishable from the "plastic" material which is "destructible" at the temperature of the molten metal to be cast. The destructible plastic material can comprise any suitable low temperature fusible substance, such as a thermoplastic resinous material or any other plastic material which gasifies substantially without residue. The expression "destructible" as applied to the plastic layer is intended to designate materials which are quickly destroyed by the molten metal, thereby enabling the molten material to occupy the space originally occupied by the destructible material. Among the materials which have been found satisfactory for the plastic are polystyrene and resinous polymerized derivatives of methacrylic acid. Partially pre-expanded polystyrene pellets can be applied to the mold and fully expanded, via a steam expansion step, or other suitable and accepted method around the first core 10 so as to form a destructible plastic layer.

The core material can be any of the known core materials used in the casting art. While a "core" material might also be considered "non-destructible" in the sense that it is able to resist the effects of the molten metal, as is the insert, to produce a void in the casting, as known to the skilled artisan, the core material is easily be removable after casting, e.g., by being broken, while the insert maintains its integrity with the casting. The core may be formed of sand and a suitable binder, for example silica sand and a phenolic binder, or formed of other known core materials.

The first preformed core 10, the destructible layer 20 and the insert 12 form a composite core subassembly 35 which can be handled as a one-piece unit. If required, the composite subassembly can be dried, for example, in a microwave oven, to remove any residual water from the steam expansion step. Also, the composite subassembly may be dipped into a solution of protective surface coating to provide a better casting finish for the ultimate metal casting.

Thereafter, a second or outer core 30 is formed around a portion of the composite subassembly 35 so as to intimately contact and form to the configuration thereof. This can be accomplished by placing the subassembly 35 into a second corebox and core blower and blowing a suitable core composition, such as silica sand and binder, therearound. The outer core 30 is thus blown in place in overlying relation to a portion of the destructible layer 20 to encompass or surround the latter. An inner surface 34 of the outer core 30 intimately contacts and forms to the configuration of the outer surface 26 of the destructible layer 20.

Due to the irregular configuration of the subassembly 35, the outer core 30 is permanently secured thereto. That is, the outer core 30 cannot be removed in any direction.

The inner core 10, together with the molded-in-place plastic layer 20, the molded-in-place outer core 30 and the positioned and retained insert 12 form a final core assembly 50. This assembly 50 can be inserted directly into a pre-formed cavity in the green sand of the drag half of the mold. A cope portion of the mold is then positioned over the drag portion, whereafter a molten iron charge is poured into the mold cavity to form the cylinder head. The destructible plastic layer 20 is gasified and replaced by the molten metal as it enters the mold. The vapors of the plastic layer can be allowed to escape from the mold through suitable vent holes. During the same time the destructible plastic layer is gasified, the insert remains in the same location until the precise time the plastic layer is replaced by the molten metal.

Although the present invention has been described above with reference to a composite assembly of two cores, one insert and an intermediate layer of expanded cellular plastic material, it will be understood by those skilled in the art that the coring assembly may include three or more cores, each core being formed onto and spaced from the next inner core by a layer of cellular plastic material and multiple inserts, e.g., an insert for each valve seat. The invention as thus described also obviates the necessity for assembling cores, inserts and gasifiable portions by instead forming about the insert and core, in a single molding step, a unitary assembly.

An alternative preferred embodiment of the present invention involves the production of a solid casting having at least one insert, such as, for example, a piston having a ceramic end as shown in FIG. 2. A ceramic insert 70 is positioned in a molding machine. Subsequently, a destructible plastic form 75 is molded-in-place integral with the insert and in the configuration of the desired shape. The destructible plastic form supports the insert such that it cannot be removed in any direction. In this embodiment, the plastic form is solid, as opposed to the previous embodiment wherein the plastic form is molded in a layer about a core.

This subassembly of the plastic form having the insert supported therein can be inserted into a pre-formed cavity in the green sand of the drag half of the mold. The cope portion of the mold is then positioned over the drag portion, whereafter a molten metal charge is poured into the mold cavity to form the piston by vaporizing the plastic form. Similarly, the vapors from the destroyed plastic are allowed to escape through suitable vent holes.

As with the cylinder head casting described above, the destructible plastic form is vaporized by the molten metal and the insert is supported in its location until the precise time the plastic is replaced with the metal.

Although the embodiment just described comprises one insert, two or more inserts may be included when the plastic form is molded. Similarly, it is possible to cast metal castings having combinations of these two methods, i.e., a casting having an opening defined by an insert (such as the valve seat) and a solid portion having an insert embedded therein. In essence, the present invention contemplates forming destructible plastic patterns having at least one insert positioned therein in any necessary orientation so as to form metal castings having the insert precisely located therein.

The invention is additionally illustrated in connection with the following Example which is to be considered as illustrative of the present invention. It should be understood, however, that the invention is not limited to the specific detail of the Example.

EXAMPLE

A first core 10 is formed in a mold or corebox from silica sand and a phenolic base and/or modified phenolic base resin binder compound. The valve seat inserts 12 are positioned around sections 11 of the first core 10 and the first core/insert subassembly is placed into a mold or corebox which is thereafter filled with partially expanded polystyrene pellets. The pellets are then expanded to form a destructible layer 20 therearound in intimate contact with the first core 10 and the inserts 12, thereby creating the composite core subassembly defined by the first core, the destructible plastic layer, and the inserts. Then the subassembly is dipped into a protective surface coating to perfect the casting finish.

The subassembly is thereafter placed into another mold or corebox which is filled with silica sand and phenolicisocyanate binder activated by a triethylamine or dimethylethylamine catalyst to form a second core 30 around the destructible layer of the subassembly in intimate contact therewith.

The resulting assembly is then placed in the drag portion of a mold assembly containing foundry sand and other conventional core assembly components are placed about the assembly to form a composite mold assembly suitable for forming a casting of a cylinder head. The cope portion of the mold assembly is combined with the drag portion in a conventional manner. A casting is made using this composite mold assembly using conventional techniques. The interior of resulting casting is smooth-surfaced, free of pits and fins and is suitable for use as a cylinder head having inserts defining the valve seats.

As stated above, the foregoing example is illustrative and is not meant to limit the present invention thereby. The method of the present invention is to provide castings having inserts precisely located therein. Accordingly, the method of the present invention is applicable to various casting techniques, such as green sand or what is known in the art as the full mold process, or other techniques known to skilled artisans where a destructible material can be used to support at least one insert.

While we have shown and described specific embodiments of our invention, it will be understood that these embodiments are merely for the purpose of illustration and description and that various other forms may be devised within the scope of our invention, as defined in the appended claims.

What is claimed is:

1. A core assembly useful in casting metal castings, comprising: at least one insert; a unitary destructible thermoplastic form molded-in-place at least partially about said at least one insert and supporting said at least one insert; and an outer core.

2. A core assembly as defined by claim 1 wherein said at least one insert comprises metal or ceramic.

3. A core assembly as defined by claim 1 wherein said destructible thermoplastic form comprises expanded thermoplastic resinous pellets.

4. A core assembly as defined by claim 1 wherein said outer core comprises sand an a binder.

5. A core assembly as defined by claim 15 further comprising an inner core at least partially about which said destructible thermoplastic form is molded-in-place.

6. A core assembly as defined by claim 5 wherein said inner core comprises sand and a binder.

7. A method of casting metal castings including an insert comprising the steps of:

forming a composite core assembly by:

positioning in a mold cavity, which includes at least one core, at least one insert;

molding in said mold cavity a destructible form of plastic material at least partially about said at least one insert and core to form said composite core assembly wherein said at least one insert is supported by said plastic material;

inserting said composite core assembly into a second mold cavity; and introducing molten metal into said second mold cavity to destroy said plastic form and produce a casting having said at least one insert integral therewith and at least one passage.

8. A method as defined by claim 7 wherein said at least one insert comprises a metal or ceramic.

9. A method as defined by claim 7 wherein said step of molding comprises introducing thermoplastic resinous pellets into said mold cavity and expanding said pellets to form said composite core assembly.

10. A method as defined by claim 9 wherein said thermoplastic resinous pellets comprise polystyrene.

11. A method as defined by claim 7 wherein said step of molding also comprises molding said plastic form around a preformed core.

12. A method as defined by claim 11 wherein said at least one insert is positioned about said preformed core.

13. A method of casting metal castings comprising the steps of:

forming a composite core assembly by:

fabricating a first core having an outer surface portion;

positioning in a mold cavity at least one insert and said first core;

molding in said mold cavity a destructible form of plastic material at least partially about said outer surface portion of said first core and said at least one insert, such that an inner portion of said plastic form intimately contacts and forms to the configuration of said outer surface portion to interlock said first core and said plastic form, and such that said at least one insert is supported by said plastic form;

molding a second core in encompassing relationship around an outer portion of said plastic form, such that an inner portion of said second core intimately contacts and at least partially forms to the configuration of said outer portion of said plastic form to interlock said second core and said plastic form together to form said composite core assembly;

inserting said composite core assembly into a second mold cavity; and introducing molten metal into said second mold cavity to destroy said plastic form and to produce a casting having said at least one insert integral therewith and at least one passage.

14. A method as defined by claim 13 wherein said at least one insert comprises a metal or ceramic.

15. A method as defined by claim 13 wherein said first core comprises sand and a binder.

16. A method as defined by claim 13 wherein said second core comprises sand and a binder.

17. A method as defined by claim 13 wherein said step of molding comprises introducing thermoplastic resinous pellets into said mold cavity and expanding said pellets to form said destructible plastic form.

18. A method as defined by claim 17 wherein said thermoplastic resinous pellets comprise polystyrene.

* * * * *

UNITED STATES PATENT AND TRADEMARK OFFICE

CERTIFICATE OF CORRECTION

PATENT NO. : 4,691,754

DATED : 8 September 1987

INVENTOR(S) : David V. Trumbauer et al

It is certified that error appears in the above-identified patent and that said Letters Patent is hereby corrected as shown below:

Claim 4, line 2, change "an" to -- and --.

Claim 5, line 1, change "15" to -- 1 --.

Signed and Sealed this

Fourteenth Day of June, 1988

*Attest:*

DONALD J. QUIGG

*Attesting Officer*

*Commissioner of Patents and Trademarks*